US011293316B2

(12) United States Patent
Muramatsu et al.

(10) Patent No.: US 11,293,316 B2
(45) Date of Patent: Apr. 5, 2022

(54) MUFFLER STRUCTURE OF SADDLE-TYPE VEHICLE

(71) Applicant: SUZUKI MOTOR CORPORATION, Hamamatsu (JP)

(72) Inventors: Takayoshi Muramatsu, Hamamatsu (JP); Takanori Chino, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 296 days.

(21) Appl. No.: 16/582,818

(22) Filed: Sep. 25, 2019

(65) Prior Publication Data

US 2020/0123947 A1 Apr. 23, 2020

(30) Foreign Application Priority Data

Oct. 19, 2018 (JP) ..... JP2018-197393

(51) Int. Cl.
*F01N 1/08* (2006.01)
*F01N 1/02* (2006.01)

(52) U.S. Cl.
CPC ..... *F01N 1/085* (2013.01); *F01N 1/026* (2013.01); *F01N 1/082* (2013.01); *F01N 2210/04* (2013.01); *F01N 2470/02* (2013.01); *F01N 2470/24* (2013.01); *F01N 2490/04* (2013.01); *F01N 2590/04* (2013.01)

(58) Field of Classification Search
CPC ..... F01N 1/026; F01N 1/085; F01N 2210/04; F01N 2470/24
See application file for complete search history.

(56) References Cited

U.S. PATENT DOCUMENTS 5,280,143 A * 1/1994 Kakuta ..... F02B 27/04 181/250
6,382,348 B1 * 5/2002 Chen ..... F01N 1/089 181/232
6,510,921 B2 * 1/2003 Price ..... F01N 1/24 181/264
2008/0035418 A1 * 2/2008 Marocco ..... F01N 3/2892 181/211
2020/0088077 A1 * 3/2020 Kienle ..... F01N 3/0211

FOREIGN PATENT DOCUMENTS

DE 4431484 A1 * 3/1996 ..... F01N 3/2892
JP 2016-070208 A 5/2016

* cited by examiner

*Primary Examiner* — Jonathan R Matthias
(74) *Attorney, Agent, or Firm* — Stein IP, LLC

(57) ABSTRACT

There is provided a muffler structure of a saddle-type vehicle. The muffler structure is disposed at a downstream side of an exhaust pipe extending from an exhaust port of a cylinder head. A pipe is connected to the exhaust pipe and inserted into a muffler main body. The pipe is provided with an expansion chamber having an inner diameter that is larger than an inner diameter of the exhaust pipe. At least a part of the expansion chamber is disposed in the muffler main body, and a plurality of through holes are formed on an outer peripheral surface of the expansion chamber disposed in the muffler main body.

7 Claims, 4 Drawing Sheets

MUFFLER STRUCTURE OF SADDLE-TYPE VEHICLE

CROSS-REFERENCE TO RELATED APPLICATIONS

The disclosure of Japanese Patent Application No. 2018-197393 filed on Oct. 19, 2018, including specification, drawings and claims is incorporated herein by reference in its entirety.

TECHNICAL FIELD

The present disclosure relates to a muffler structure of a saddle-type vehicle.

BACKGROUND

In a muffler of a saddle-type vehicle, there is known a structure in which the inner part of the muffler is divided by a separator into a plurality of spaces, and these spaces are communicated by a plurality of communication pipes (for example, see Patent Document 1). In the muffler, by adopting the above-described structure, an amount of protrusion to an outer side in a vehicle width direction at a rear side of the muffler is suppressed to improve handling and realize smart styling.

Patent Document 1: Japanese Patent Application Publication No. 2016-070208 A

However, in the muffler described in Patent Document 1, the structure in the muffler is complicated, and the weight of the muffler itself increases due to the number of constituent elements of the separator and the communication pipes. In the muffler of a saddle-type vehicle, a simple and lightweight structure is required while securing a sufficient muffling effect.

SUMMARY

It is at least one of objects of the present disclosure to provide a muffler structure of a saddle-type vehicle, which can realize a simple and lightweight structure while securing a sufficient muffling effect.

According to an aspect of the embodiments of the present disclosure, there is provided a muffler structure of a saddle-type vehicle, disposed at a downstream side of an exhaust pipe extending from an exhaust port of a cylinder head, the muffler structure comprising: a muffler main body; and a pipe connected to the exhaust pipe and inserted into the muffler main body, wherein the pipe is provided with an expansion chamber having an inner diameter that is larger than an inner diameter of the exhaust pipe, and wherein at least a part of the expansion chamber is disposed in the muffler main body, and a plurality of through holes are formed on an outer peripheral surface of the expansion chamber disposed in the muffler main body.

With the above configuration, a simple and lightweight structure can be realized while securing a sufficient muffling effect.

DETAILED DESCRIPTION OF THE EMBODIMENTS

Hereinafter, embodiments of the present disclosure are described in detail with reference to the accompanying drawings. Although an example is described in which a muffler structure according to the present disclosure is applied to a motorcycle of a sport type, but the application subject is not limited thereto and modifications may be made. For example, the muffler structure according to the present disclosure may be applied to a saddle-type vehicle such as a motorcycle of other types, an automatic three-wheeled vehicle of a buggy type, and an automatic four-wheel vehicle. In terms of direction, an arrow FR indicates a vehicle front side, an arrow RE indicates a vehicle rear side, an arrow UP indicates a vehicle upper side, and an arrow LO indicates a vehicle lower side respectively. In the following drawings, a part of the configuration is omitted for convenience of description.

Figure 1:
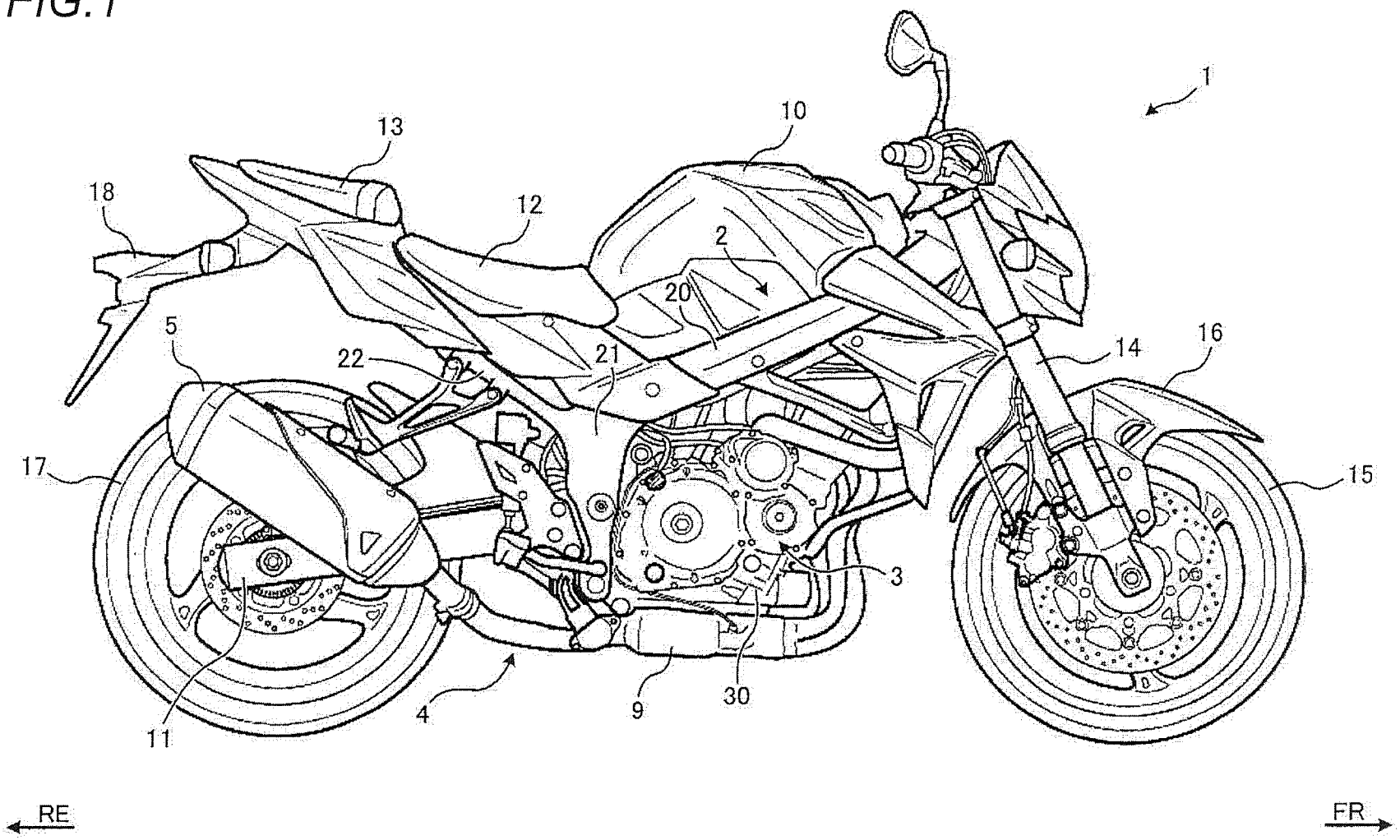
FIG. 1 is a left side view illustrating a schematic configuration of a motorcycle.

First, a schematic configuration of a motorcycle to which a muffler structure according to the present disclosure is applied will be described with reference to FIG. 1. FIG. 1 is a left side view illustrating a schematic configuration of the motorcycle. In the following description, an upstream side indicates the upstream side of a flow direction of exhaust gas, and a downstream side indicates the downstream side of the flow direction of the exhaust gas. In the present embodiment, the upstream side corresponds to the vehicle front side, and the downstream side corresponds to the vehicle rear side.

As illustrated in FIG. 1, a motorcycle 1 is configured such that an engine 3 is suspended as a part of a power unit on a vehicle body frame 2 on which parts such as an electrical system are mounted. The engine 3 is, for example, a parallel four-cylinder engine. The engine 3 is configured such that a cylinder head and a cylinder head cover (not illustrated) are attached to an upper portion of an engine case 30 in which a crankshaft (not illustrated) or the like is housed. An oil pan (not illustrated) is provided in a lower portion of the engine case 30.

The vehicle body frame 2 is a twin spar type frame formed of iron, aluminum alloy or the like, and obtains rigidity as an entire vehicle body by suspending the engine 3 as described above. The vehicle body frame 2 as a whole body has a shape that extends from a front side to a rear side and is curved downward at a rear end side.

Specifically, the vehicle body frame 2 includes a main frame 20 extending rearward from a head pipe (not illustrated) in a left-right bifurcated manner, and a body frame 21 extending downward from a rear end of the main frame 20. A fuel tank 10 is disposed at an upper portion of the main frame 20. A swing arm 11 is swingably supported at a substantially center portion of the body frame 21 in an upper-lower direction. The swing arm 11 extends rearward.

A seat rail (not illustrated) and a back stay 22 extending rearward and upward are provided at an upper end of the body frame 21. The seat rail is provided with a rider seat 12 connected to the fuel tank 10 and a pillion seat 13.

A pair of left and right front forks 14 is steerably supported on the head pipe via a steering shaft (not illustrated). A front wheel 15 is rotatably supported at a lower portion of the front fork 14, and an upper side of the front wheel 15 is covered with a front fender 16. A rear wheel 17 is rotatably supported at a rear end of the swing arm 11. An upper portion of the rear wheel 17 is covered with a rear fender 18.

An exhaust pipe 4 configuring an exhaust pipe is connected to each exhaust port of the cylinder head. A muffler 5 configuring the muffler is connected to a rear side of the exhaust pipe 4. A plurality of (four in the present embodiment) exhaust pipes 4 extend downward from each exhaust port, are integrated into one pipe after being bent rearward at a lower front side of the engine 3, and extend toward the vehicle rear side. The muffler 5 is connected to the rear end of the exhaust pipe 4 integrated into one.

In a muffler of a saddle-type vehicle, there is known a structure in which the inner part of the muffler is divided by a separator into a plurality of spaces, and these spaces are communicated by a plurality of communication pipes. However, in such a muffler, the structure in the muffler is complicated, and the weight of the muffler itself is increased due to the number of constituent elements of the separator and the communication pipes. In the muffler of a saddle-type vehicle represented by a motorcycle, from the viewpoint of reducing the weight and the manufacturing cost of the vehicle, it is required to realize a simple and lightweight structure while securing a sufficient muffling effect.

In the structure in which the inner part of the muffler is divided by the separator into a plurality of spaces and those spaces are communicated by the communication pipes, there is a limit in reducing the weight and material cost of the muffler itself. Further, securing the function as an expansion chamber in the muffler while reducing the components such as the separator and the communication pipes as much as possible contributes to the realization of a simple and lightweight structure while securing a sufficient muffling effect.

Specifically, at least a part of the expansion chamber is disposed in a muffler main body and a plurality of through holes are formed on an outer peripheral surface of the expansion chamber disposed in the muffler main body, in the muffler structure in which the expansion chamber having an inner diameter which is larger than the inner diameter of the exhaust pipe is provided in a part of a pipe inserted into the muffler main body.

According to the present disclosure, the expansion chamber is provided in a part of the pipe inserted into the muffler main body, and the plurality of through holes are formed in the outer peripheral surface of the expansion chamber disposed in the muffler main body, so that exhaust gas flowing from the exhaust pipe can be diffused in the expansion chamber, and a first muffling effect can be obtained. Further, the exhaust gas can be diffused in the muffler main body by flowing out through the through holes of the expansion chamber, so that a second muffling effect can be obtained. Further, the expansion chamber is provided in a part of the pipe, so that it is not necessary to provide a plurality of expansion chambers in the muffler main body, and an accompanying increase in the number of components can be avoided. Therefore, a simple and lightweight structure can be realized while securing a sufficient muffling effect.

Figure 2A:
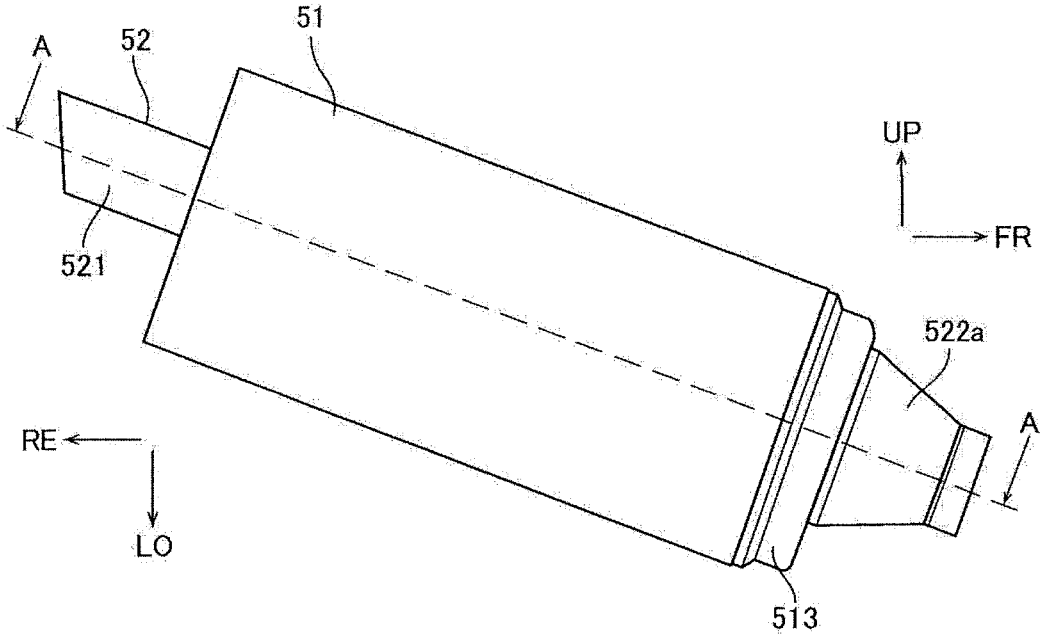
FIGS. 2A and 2B are a left side view and a top view of a muffler of the motorcycle according to the present embodiment.
Figure 2B:
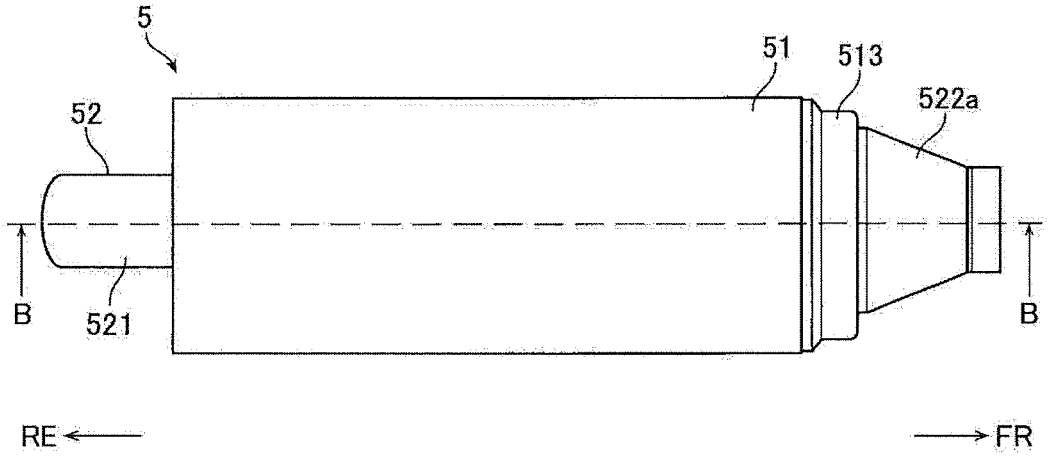
Figure 3A:
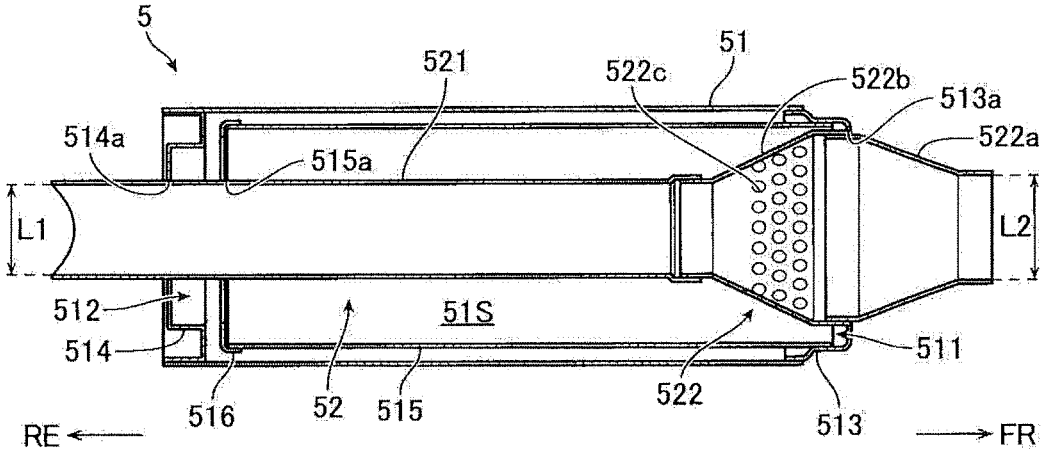
FIG. 3A is a cross-sectional view taken along a broken line A shown in FIG. 2A.
Figure 3B:
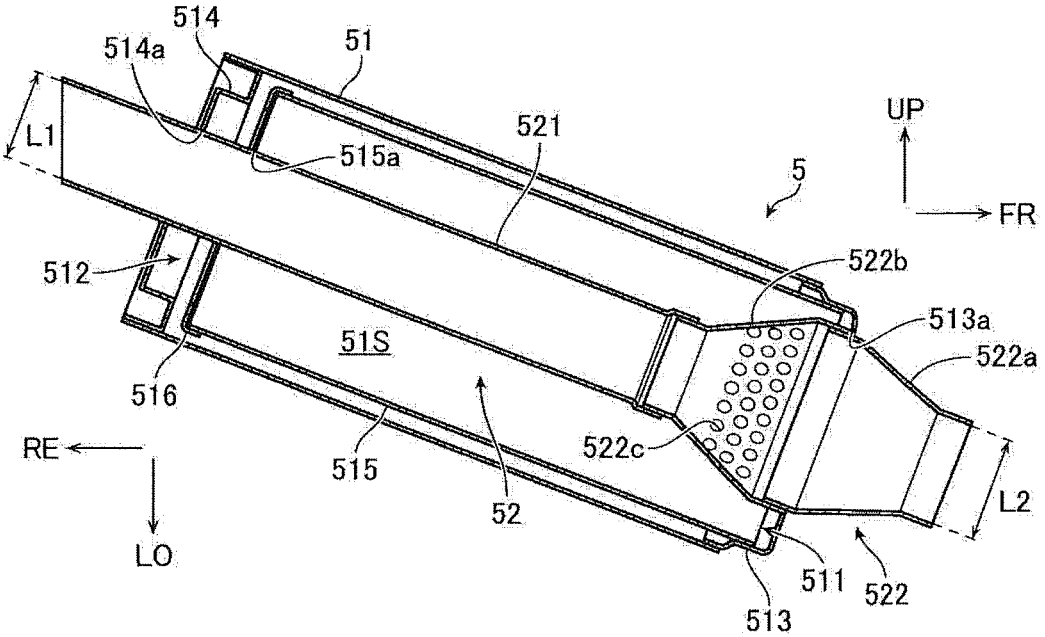
FIG. 3B is a cross-sectional view taken along a broken line B shown in FIG. 2B.

FIGS. 2A and 2B are a left side view and a top view of a muffler 5 of the motorcycle according to the present embodiment. FIG. 3A is a cross-sectional view taken along a broken line A shown in FIG. 2A, and FIG. 3B is a cross-sectional view taken along a broken line B shown in FIG. 2B. In FIGS. 2A, 2B and 3A, 3B, for the convenience of explanation, the structure of the muffler 5 shown in FIG. 1 is schematically illustrated, and a tail cover attached to a rear end portion of the muffler 5 is omitted.

As shown in FIGS. 2 and 3, the muffler 5 includes a muffler main body 51 configuring the muffler main body, and a pipe 52 inserted into the muffle main body 51. The muffler main body 51 has a generally cylindrical shape, and is disposed with opening parts thereof directed in a front-rear direction of the vehicle. More specifically, the muffler main body 51 is disposed with a front opening part 511 directed slightly downward, and a rear opening part 512 directed slightly upward (see FIG. 3).

In the muffler main body 51, a nose cap 513 is attached to the front opening part 511, and a tail cap 514 is attached to the rear opening part 512 (see FIG. 3). The nose cap 513 and the tail cap 514 are joined to an inner wall of the muffler main body 51 by welding or the like, and configure a part of the muffler main body 51. The nose cap 513 configures a wall surface of a front end portion (upstream side end portion) of the muffler main body 51 that supports a part of the pipe 52 (an expansion chamber 522 to be described below). The tail cap 514 configures a wall surface of a rear end portion (downstream side end portion) of the muffler main body 51 that supports a part of the pipe 52 (a tubular portion 521 to be described below).

An inner cylindrical portion 515 is housed in the muffler main body 51. The inner cylindrical portion 515 has a cylindrical shape opened in the front-rear direction. The inner cylindrical portion 515 is disposed over substantially the entire space in the muffler main body 51. An outer circumferential surface of a front end portion of the inner cylindrical portion 515 is joined to an inner wall surface of the nose cap 513 by press fitting or the like, and a rear end portion of the inner cylindrical portion 515 is supported by a bracket 516. At the rear end portion of the inner cylindrical portion 515, an opening part 515*a* through which a part of the pipe 52 (the tubular portion 521 to be described below) is inserted is formed.

The pipe 52 has a cylindrical tubular portion 521 and an expansion chamber 522. The pipe 52 is disposed so as to penetrate the muffler main body 51 from the upstream side to the downstream side of the exhaust gas. The expansion chamber 522 is disposed at the upstream side of a center portion of the muffler main body 51 in the front-rear direction. The expansion chamber 522 is disposed at a position on the upstream side of the pipe 52. The tubular portion 521 is disposed at a position on the downstream side of the expansion chamber 522. The expansion chamber 522 is connected to an exhaust pipe 4 at an upstream side end portion, and is connected to the tubular portion 521 at a downstream side end portion. The upstream side end portion of the tubular portion 521 is joined to the downstream side end portion of the expansion chamber 522 (more specifically, a reduced diameter portion 522*b* to be described below) by press fitting.

The expansion chamber 522 has an inner diameter that is larger than an inner diameter of the exhaust pipe 4. The expansion chamber 522 has an enlarged diameter portion 522*a* and a reduced diameter portion 522*b*. The enlarged diameter portion 522*a* is disposed at a position on the upstream side in the expansion chamber 522, and an upstream side end portion thereof is connected to the exhaust pipe 4. The enlarged diameter portion 522*a* has a tapered shape in which an inner diameter of the downstream side thereof is greatly enlarged relative to an inner diameter of the upstream side thereof. The reduced diameter portion 522*b* is disposed at a position on the downstream side in the expansion chamber 522, an upstream side end portion thereof is connected to the enlarged diameter portion 522*a*, and a downstream side end portion thereof is connected to the tubular portion 521. The reduced diameter portion 522*b* has a tapered shape in which an inner diameter of the downstream side thereof is smaller relative to an inner diameter of the upstream side thereof. The enlarged diameter portion 522*a* and the reduced diameter portion 522*b* are joined by welding, for example, but the present disclosure is not limited thereto. The reduced diameter portion 522*b* and the enlarged diameter portion 522*a* may also be joined by press fitting.

The expansion chamber 522 is supported by the nose cap 513 attached to the opening part 511 of the muffler main body 51. The nose cap 513 has an outer shape corresponding to the shape of the inner wall of the front end portion (upstream side end portion) of the muffler main body 51, and an opening part 513*a* is formed at the center thereof. The opening part 513*a* has a shape corresponding to the outer shape of the expansion chamber 522. The expansion chamber 522 is supported by the nose cap 513 by being inserted into the opening part 513*a*.

More specifically, the expansion chamber 522 is supported by the nose cap 513 at a junction of the enlarged diameter portion 522*a* and the reduced diameter portion 522*b*. In other words, the expansion chamber 522 is supported by the nose cap 513 at a portion with the largest outer diameter dimension. The expansion chamber 522 is disposed so as to cross the nose cap 513 by being supported as described above. In this case, the enlarged diameter portion 522*a* is disposed at the position on the upstream side of the nose cap 513, and the reduced diameter portion 522*b* is disposed at the position on the downstream side of the nose cap 513. That is, the enlarged diameter portion 522*a* is disposed outside the muffler main body 51, and the reduced diameter portion 522*b* is disposed inside the muffler main body 51 (more specifically, in a space 51*s*).

The tubular portion 521 is supported by the tail cap 514 attached to the opening part 512 of the muffler main body 51. The tail cap 514 has an outer shape corresponding to the shape of the inner wall of the rear end portion (downstream side end portion) of the muffler main body 51, and an opening part 514*a* is formed at the center thereof. The opening part 514*a* has a shape corresponding to the outer shape of the tubular portion 521. The tubular portion 521 is supported by the tail cap 514 by being inserted into the opening part 514*a*. A part of the tubular portion 521 disposed at the rear side relative to the tail cap 514 configures a tail pipe.

An inner diameter dimension L1 of the tubular portion 521 is configured to be slightly smaller than an inner diameter dimension L2 of the upstream side end portion of the enlarged diameter portion 522*a* of the expansion chamber 522. Therefore, the exhaust gas flowing into the expansion chamber 522 from the exhaust pipe 4 comes into contact with the downstream inner peripheral surface (inner peripheral surface where punching holes 522*c* described later are not formed) of the reduced diameter portion 522*b*, and is guided to the center side of the pipe 52. Accordingly, the exhaust efficiency of the exhaust gas flowing through the pipe 52 can be improved.

The expansion chamber 522 is supported by the nose cap 513, and the tubular portion 521 is supported by the tail cap 514, so that a space 51*s* in the muffler main body 51 (inner cylindrical portion 515) is sealed except for the punching holes 522*c* to be described later. In the muffler 5 according to the present embodiment, the space 51*s* in the muffler main body 51 is used as an expansion chamber. More specifically, in the muffler 5, the expansion chamber 522 described above is used as a first expansion chamber, and the space 51*s* in the muffler main body 51 is used as a second expansion chamber.

On the outer peripheral surface of the reduced diameter portion 522*b* configuring the expansion chamber 522, the punching holes 522*c* configured by a plurality of through holes are formed. The punching holes 522*c* are arranged at equal intervals in a predetermined region on the upstream side of the outer peripheral surface of the reduced diameter portion 522*b*. The punching holes 522*c* bring the space in the expansion chamber 522 into communication with the space 51*s* in the muffler main body 51 (more specifically, the inner cylindrical portion 515). In other words, the space in the expansion chamber 522 and the space 51*s* in the muffler main body 51 communicate with each other through the punching holes 522*c*.

Figure 4A:
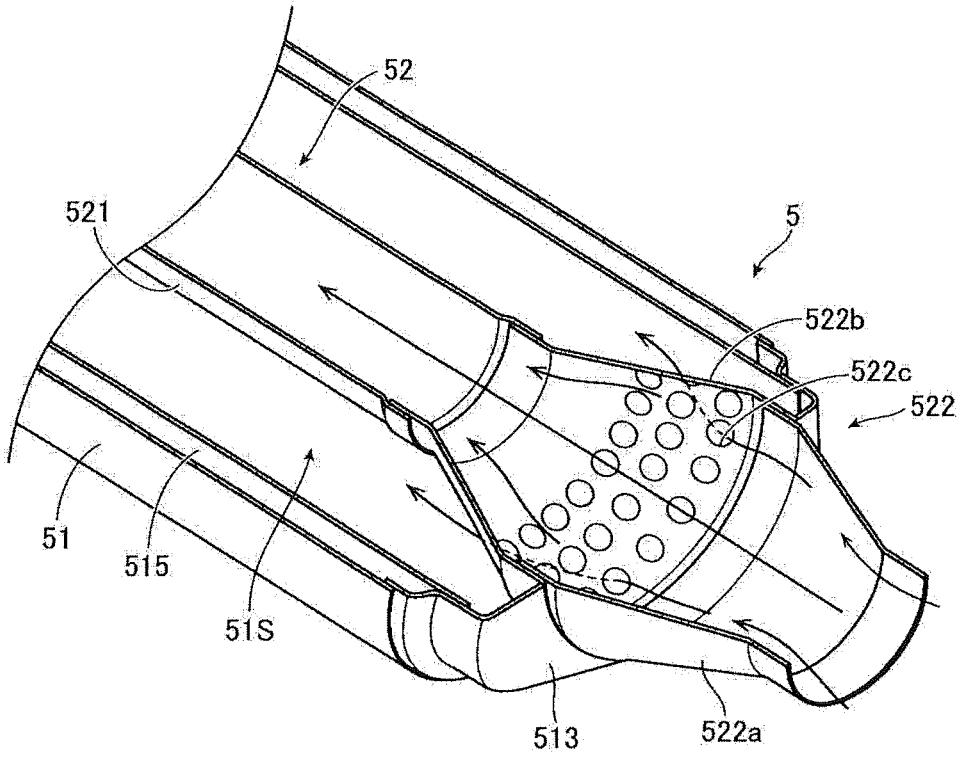
FIGS. 4A and 4B are enlarged perspective views of the periphery of an expansion chamber of a pipe in FIG. 3B.
Figure 4B:
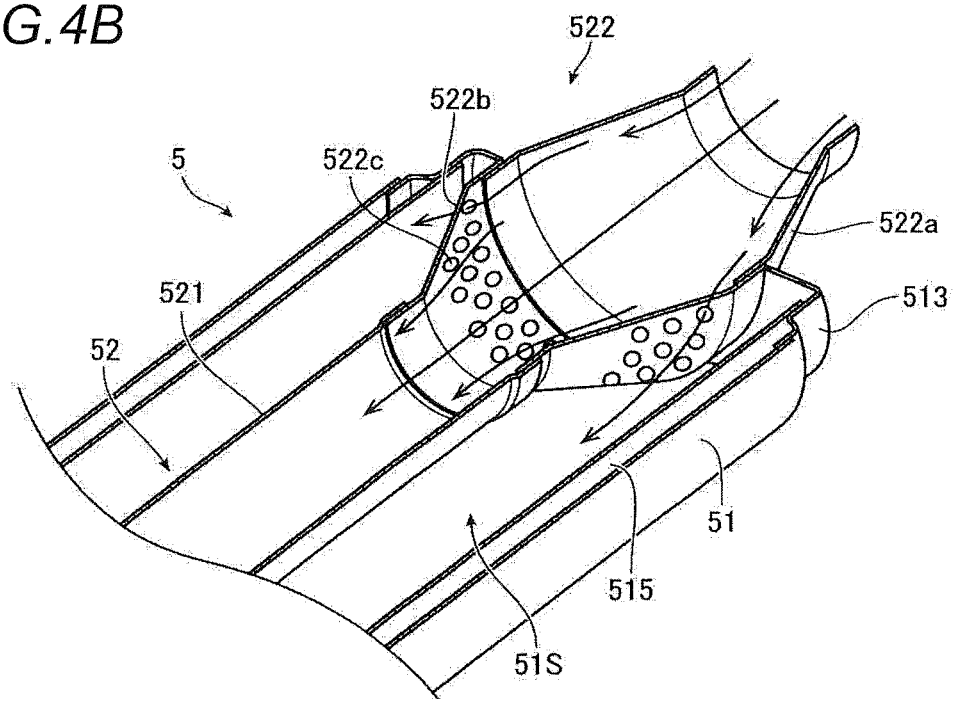

Next, the flow of the exhaust gas in the muffler 5 with the above configuration will be described with reference to FIGS. 3 and 4. FIGS. 4A and 4B are enlarged perspective views of the periphery of the expansion chamber 522 of the pipe 52 in FIG. 3B. In FIG. 4, the flow of the exhaust gas is indicated by arrows. Exhaust gas generated by combustion in the engine 3 flows through the exhaust pipe 4 downstream (see FIG. 1). Then, the exhaust gas flowing through the exhaust pipe 4 downstream is first introduced into the expansion chamber 522 of the pipe 52 included in the muffler 5.

As described above, the expansion chamber 522 has the inner diameter that is larger than the inner diameter of the exhaust pipe 4. Therefore, when being introduced into the expansion chamber 522 from the exhaust pipe 4, the exhaust gas is diffused at a position corresponding to the enlarged diameter portion 522*a* of the expansion chamber 522 and is muffled (first muffling effect).

The exhaust gas flowing in the vicinity of the inner peripheral surface of the expansion chamber 522 (enlarged diameter portion 522*a*) flows along the inner wall surface of the reduced diameter portion 522*b* as going downstream, and is guided near the center of the pipe 52. At this time, part of the exhaust gas flows into the space 51*s* of the muffler main body 5 through the punching holes 522*c* formed in the reduced diameter portion 522*b*. Therefore, the exhaust gas is muffled by being diffused in the muffler main body 51 (second muffling effect). The exhaust gas that has entered the space 51*s* through the punching holes 522*c* can also obtain a muffling effect by resonating with each other.

In this case, the expansion chamber 522 is disposed at the upstream side of the center portion (center portion between the upstream side and the downstream side in the flow direction of the exhaust gas) of the muffler main body 51. Therefore, compared with the case where the expansion chamber 522 is disposed at the downstream side, the exhaust gas flowing in the pipe 52 can flow into the muffler main body 51 on the upstream side. As a result, the exhaust gas can be easily diffused in the muffler main body 51.

On the other hand, the exhaust gas flowing near the center of the expansion chamber 522 passes through the expansion chamber 522 and flows into the tubular portion 521 without being affected by the expansion chamber 522 (enlarger diameter portion 522*a* and reduced diameter portion 522*b*). That is, the exhaust gas flows directly from the exhaust pipe 4 into the tubular portion 521. Therefore, even in a case where the expansion chamber 522 is provided in the pipe 52, an increase in pressure loss of the exhaust gas can be suppressed, and a reduction in engine output can be prevented.

According to the muffler structure of the present embodiment, the expansion chamber 522 is provided in a part of the pipe 52 inserted into the muffler main body 51, and the punching holes 522*c* are formed on the outer peripheral surface of the expansion chamber 522 disposed in the muffler main body 51, so that the exhaust gas flowing from the exhaust pipe 4 can be diffused in the expansion chamber 522, and the first muffling effect can be obtained. Further, the exhaust gas can be diffused in the muffler main body 51 by flowing out through the punching holes 522*c* of the expansion chamber 522, so that the second muffling effect can be obtained. Further, the expansion chamber 522 is provided in a part of the pipe 52, so that it is not necessary to provide a plurality of expansion chambers in the muffler main body 51, and an accompanying increase in the number of components can be avoided. Therefore, a simple and lightweight structure can be realized while securing a sufficient muffling effect.

In particular, the expansion chamber 522 is provided with the enlarged diameter portion 522*a* at a position on the upstream side, and the reduced diameter portion 522*b* at a position on the downstream side. The punching holes 522*c* are formed on the outer peripheral surface of the reduced diameter portion 522*b*. Therefore, the exhaust gas introduced into the expansion chamber 522 is diffused on the upstream side of the expansion chamber 522 while being guided to the center side of the pipe 52 on the downstream side and flows downstream. Further, the exhaust gas flowed near the center of the expansion chamber 522 flows directly into the pipe 52 without being affected by the expansion chamber 522. Accordingly, the increase in the pressure loss can be suppressed while securing the muffling effect by the expansion chamber 522 within a limited range in the pipe 52, and the exhaust efficiency can be improved.

The expansion chamber 522 is disposed so as to cross the nose cap 513 configuring the upstream side end portion of the muffler main body 51. The enlarged diameter portion 522*a* configuring the expansion chamber 522 is disposed outside the muffler main body 51. Thus, the enlarged diameter portion 522*a* not communicating with the muffler main body 51 and not forming with the punching holes 522*c* is disposed outside the muffler main body 51, so that the length of the muffler main body 51 that is conspicuous in appearance can be shortened. Further, the enlarged diameter portion 522*a* is disposed at the upstream side of the muffler main body 51, so that it is possible to suppress the step on the appearance from the exhaust pipe 4 disposed at the upstream side to the muffler main body 51 with a large diameter. As a result, a compact and smart appearance of the muffler 5 can be realized.

Further, in the muffler structure according to the present embodiment, the pipe 52 is disposed so as to penetrate the muffler main body 51 from the upstream side end portion to the downstream side end portion of the muffler main body 51. Since the pipe 52 is disposed so as to penetrate the muffler main body 51 as described above, it is possible to omit components such as a separator that divides the inner part of the muffler main body 51, so that a simple and lightweight muffler structure can be realized.

In this case, the pipe 52 is supported by a wall surface (nose cap 513) disposed at the upstream side end portion of the muffler main body 51, and a wall surface (tail cap 514) disposed at the downstream side end portion of the muffler main body 51. Since the pipe 52 is supported by the wall surface at the upstream side end portion and the wall surface at the downstream side end portion of the muffler main body 51 as described above, the rigidity of the structure supporting the pipe 52 can be improved, so that the occurrence of vibration or the like of the pipe 52 inside the muffler 5 can be suppressed. As a result, it is possible to suppress the generation of abnormal noise due to the vibration of the pipe 52 and to suppress the deterioration of the durability due to the vibration.

The downstream side end portion of the expansion chamber 522 and the upstream side end portion of the tubular portion 521 in the pipe 52 are joined by press fitting. The tubular portion 521 and the expansion chamber 522 by are joined by press fitting as described above, so that it is possible to release the expansion force applied at the time of thermal expansion of both members. As a result, even in a case where the expansion chamber 522 and the tubular portion 521 are disposed in combination in the muffler main body 51, a structure coping with the thermal expansion can be provided without requiring a complicated configuration.

The present disclosure is not limited to the above embodiment, and various modifications can be made. The size, shape or the like illustrated in the drawings are not limited to the above embodiment, and can be appropriately modified within a range in which the effect of the present disclosure is exhibited. Various modifications can be made without departing from the scope of the object of the present disclosure.

For example, in the above embodiment, the case where the pipe 52 penetrates the muffler main body 51 is described. However, in the muffler structure according to the present embodiment, the pipe 52 may not penetrate through the muffler main body 51, provided that the pipe 52 is inserted into the muffler main body 51 from the front side. For example, in a case where a separator that divides the space 51*s* in the muffler main body 51 is provided, the pipe 52 may be configured to have a length up to the separator. That is, a rear end portion of the pipe 52 may be disposed in the muffler main body 51. In this case, although the number of components supporting the separator and the pipe 52 is increased, a sufficient muffling effect can be obtained with a relatively simple configuration.

In the above embodiment, the case where the expansion chamber 522 is disposed at the upstream side relative to the center portion of the muffler main body 51 is described. However, the arrangement of the expansion chamber 522 is not limited thereto, and can be changed as appropriate. For example, the expansion chamber 522 may be disposed in the vicinity of the center portion of the muffler main body 51 or on the downstream side of the center portion. Further, in the above embodiment, the expansion chamber 522 is disposed so as to cross the upstream side end portion of the muffler main body 51, but the arrangement is not limited thereto, and the expansion chamber 522 may be arranged to be displaced rearward. In these cases, although the outflow timing of the exhaust gas to the space 51*s* in the muffler main body 51 is slightly delayed, the same effect as that of the above embodiment can be obtained.

In the above embodiment, the case where the expansion chamber 522 includes the enlarged diameter portion 522*a* and the reduced diameter portion 522*b* is described. However, the configuration of the expansion chamber 522 is not limited thereto, and can be changed as appropriate. For example, the expansion chamber 522 may have any shape on the premise of having an inner diameter larger than the inner diameter of the exhaust pipe 4. In this case, a simple and lightweight muffler structure can be provided although the diffusion efficiency and exhaust efficiency of the exhaust gas decrease.

In the above embodiment, the case where the pipe 52 is supported by a wall surface (nose cap 513) disposed at the upstream side end portion of the muffler main body 51, and a wall surface (tail cap 514) disposed at the downstream side end portion of the muffler main body 51 is described. However, the support manner for the pipe 52 is not limited thereto, and can be changed as appropriate. For example, in a case where a separator that divides the space 51*s* in the muffler main body 51 is provided, the pipe 52 may be supported by a part of the separator. In this case, a sufficient muffling effect can be obtained with a relatively simple configuration although the effect of suppressing the vibration of the pipe 52 is decreased.

In the above embodiment, the case where the tubular portion 521 and the downstream side end portion of the expansion chamber 522 in the pipe 52 are joined by press fitting is described. However, the joining method is not limited thereto, and can be changed as appropriate. For example, the joining may be performed by welding or the like. In this case, although the readiness to the expansion force applied at the time of thermal expansion of both components decreases, the same effect as that of the above embodiment can be obtained.

As described above, the present disclosure has an effect that a simple and lightweight structure can be realized while securing a sufficient muffling effect, and is particularly useful for a muffler of a saddle-type vehicle represented by a motorcycle.

What is claimed is:

1. A muffler structure of a saddle-type vehicle, disposed at a downstream side of an exhaust pipe extending from an exhaust port of a cylinder head, the muffler structure comprising:

a muffler main body; and a pipe connected to the exhaust pipe and inserted into the muffler main body, wherein the pipe is provided with an expansion chamber having an inner diameter that is larger than an inner diameter of the exhaust pipe, and wherein at least a part of the expansion chamber is disposed in the muffler main body, and a plurality of through holes are formed on an outer peripheral surface of the expansion chamber disposed in the muffler main body, the plurality of through holes communicate a space in the expansion chamber with a space in the muffler main body, the space in the muffler main body is sealed except for the plurality of through holes, and the expansion chamber is disposed so that the plurality of through holes are disposed at an upstream side of the muffler main body.

2. The muffler structure according to claim 1, wherein the expansion chamber is disposed at an upstream side relative to a center portion of the muffler main body.

3. The muffler structure according to claim 1, wherein the expansion chamber includes an enlarged diameter portion connected to the exhaust pipe, the enlarged diameter portion in which an inner diameter of an downstream side thereof is larger than an inner diameter of an upstream side thereof, and a reduced diameter portion connected to the enlarged diameter portion, the reduced diameter portion in which an inner diameter of an downstream side thereof is smaller than an inner diameter of an upstream side thereof, and wherein the plurality of through holes are formed on an outer peripheral surface of the reduced diameter portion.

4. The muffler structure according to claim 3, wherein the expansion chamber is disposed so as to cross an upstream side end portion of the muffler main body, and wherein the enlarged diameter portion is disposed at an outer side of the muffler main body.

5. The muffler structure according to claim 1, wherein the pipe penetrates the muffler main body from an upstream side end portion to a downstream side end portion of the muffler main body.

6. The muffler structure according to claim 5, wherein the pipe is supported by a wall surface disposed at the upstream side end portion of the muffler main body, and a wall surface disposed at the downstream side end portion of the muffler main body.

7. The muffler structure according to claim 1, wherein in the pipe, a tubular portion disposed at the downstream side of the expansion chamber and a downstream side end portion of the expansion chamber are joined by press fitting.

* * * * *